US007018174B2

(12) United States Patent
Senoo et al.

(10) Patent No.: US 7,018,174 B2
(45) Date of Patent: Mar. 28, 2006

(54) TURBINE BLADE

(75) Inventors: Shigeki Senoo, Hitachi (JP); Yoshio Sikano, Hitachinaka (JP); Eiji Saitou, Hitachi (JP); Kiyoshi Segawa, Hitachi (JP); Sou Shioshita, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 26 days.

(21) Appl. No.: 10/492,132

(22) PCT Filed: Oct. 10, 2001

(86) PCT No.: PCT/JP01/08885

§ 371 (c)(1),
(2), (4) Date: Apr. 7, 2004

(87) PCT Pub. No.: WO03/033880

PCT Pub. Date: Apr. 24, 2003

(65) Prior Publication Data

US 2004/0202545 A1 Oct. 14, 2004

(51) Int. Cl.
*F01D 9/02* (2006.01)

(52) U.S. Cl. ..... 415/191; 416/223 A; 416/DIG. 2

(58) Field of Classification Search ..... 415/191, 415/195; 416/223 A, DIG. 2
See application file for complete search history.

(56) References Cited

U.S. PATENT DOCUMENTS

| | | | | |
|---|---|---|---|---|
| 4,211,516 | A | | 7/1980 | Speil |
| 4,470,755 | A | | 9/1984 | Bessay |
| 5,035,578 | A | | 7/1991 | Tran |
| 5,292,230 | A | * | 3/1994 | Brown ..... 415/191 |
| 5,445,498 | A | | 8/1995 | Williams et al. |

FOREIGN PATENT DOCUMENTS

| | | |
|---|---|---|
| JP | 6-101406 | 4/1994 |
| JP | 9-228801 | 9/1997 |

* cited by examiner

*Primary Examiner*—Edward K. Look
*Assistant Examiner*—Richard A. Edgar
(74) *Attorney, Agent, or Firm*—Mattingly, Stanger, Malur & Brundidge, P.C.

(57) ABSTRACT

The invention is intended to reduce the profile loss.

For that purpose, according to the invention, a plurality of turbine blades are arranged in the circumferential direction of a turbine driven by a working fluid. Each of the turbine blade is formed such that the curvature of a blade suction surface, which is defined by the reciprocal of the radius of curvature of a blade surface on the blade suction surface side, is decreased monotonously from a blade leading edge defined as the upstream-most point of the blade in the axial direction toward a blade trailing edge defined as the downstream-most point of the blade in the axial direction.

9 Claims, 8 Drawing Sheets

PRIOR ART

TURBINE BLADE

TECHNICAL FIELD

The present invention relates to a turbine blade for use in turbo machines, such as a steam turbine and a gas turbine, which are driven by a working fluid.

BACKGROUND ART

As disclosed in U.S. Pat. No. 5,445,498, for example, there is known a multi-arc blade in which a plurality of arcs and straight lines are connected to each other such that only a gradient is continuous at respective junctions between adjacent two of those arcs and straight lines. As represented by such a multi-arc blade, the profile of a known turbine blade has not been designed so as to keep continuity in the curvature of a blade surface from a leading edge to a trailing edge thereof. The multi-arc blade is relatively easy to design and manufacture, but it is disadvantageous in that a pressure distribution along the blade surface is distorted at points where the curvature is discontinuous and a surface boundary layer is thickened with the distortion, thus resulting in a larger profile loss.

Regarding other known turbine blade than the multi-arc blade, JP,A 6-1014106, for example, discloses a design method comprising the steps of arranging arcs along a camber line of a blade and forming a profile of the blade as a circumscribed curve with respect to a group of those arcs. According to that design method, a leading edge and a trailing edge are each formed in an arc shape, but the curvature is discontinuous at junctions between those arc-shaped portions and other adjacent portions forming the blade profile. Hence, the curvature of the blade leading edge is extremely large, while the curvature of the blade surface is reduced in a portion just downstream of the blade leading edge. For that reason, if an inflow angle differs from the design setting point of the blade, a boundary layer is thickened or peeled off at the point where the curvature is discontinuous, thus causing a profile loss.

Further, in an area where a curvature distribution along the blade surface increases or decreases from the upstream toward downstream side, the blade surface pressure is reduced at a maximum point of the curvature, and an inverse pressure gradient occurs downstream of that point. Therefore, a boundary layer is thickened or peeled off, thus resulting in a larger profile loss.

Moreover, U.S. Pat. No. 4,211,516, for example, discloses a blade profile in which a trailing-edge wedge angle formed by a suction surface near a blade trailing edge and a tangential line with respect to a pressure surface is as large as about 10 degrees. In such a blade profile, a fluid flowing along the blade suction surface and a fluid flowing along the blade pressure surface collide against each other at the trailing edge, thus resulting in a larger profile loss.

An object of the present invention is to provide a turbine blade capable of reducing the profile loss.

DISCLOSURE OF THE INVENTION

To achieve the above object, the present invention provides a turbine blade which is arranged in plural in the circumferential direction of a turbine driven by a working fluid, wherein the turbine blade is formed such that the curvature of a blade suction surface, which is defined by the reciprocal of the radius of curvature of a blade surface on the blade suction surface side, is decreased monotonously from a blade leading edge defined as the upstream-most point of the blade in the axial direction toward a blade trailing edge defined as the downstream-most point of the blade in the axial direction.

BEST MODE FOR CARRYING OUT THE INVENTION

A turbine blade of the present invention is arranged in plural in the circumferential direction of a turbine, such as a steam turbine and a gas turbine, with the intention of taking out, as rotating forces, power by using gas (e.g., combustion gas, steam or air) or a liquid as a working fluid. One embodiment of the present invention will be described below with reference to the drawings.

Figure 2:
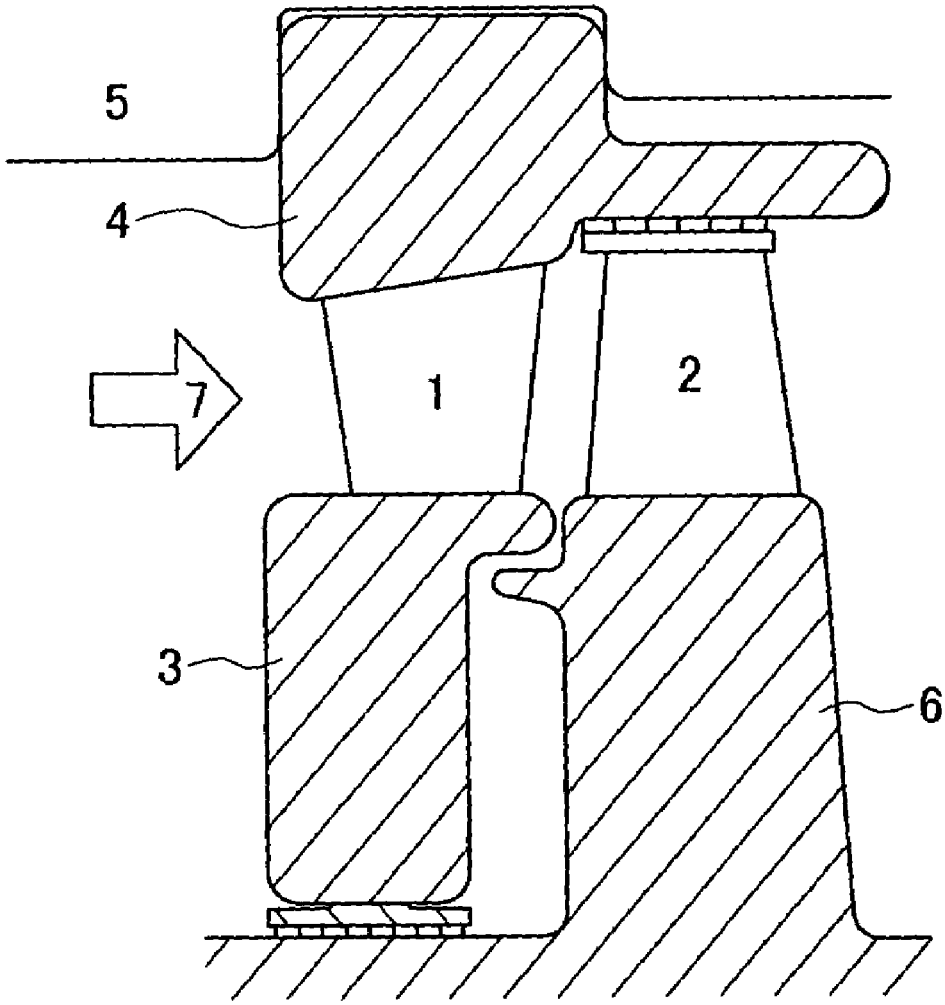
FIG. 2 is a sectional view of a turbine stage taken along a meridional plane.

FIG. 2 shows a turbine stage, comprising a stator blade and a moving blade, of a turbo machine with the intention of taking out, as rotating forces, power by utilizing a working fluid. A stator blade 1 is fixed at its inner peripheral side to a diaphragm 3 and at its outer peripheral side to a diaphragm 4. The diaphragm 4 is fixed at its outer peripheral side to a casing 5. A moving blade 2 is fixed at its inner peripheral side to a rotor 6 serving as a rotating part, and its outer peripheral side is positioned to face the diaphragm 4 with a gap left between them. A working fluid 7 flows in a direction toward the moving blade side from the stator blade 1 side of the turbine stage. The direction from which the working fluid 7 flows in is defined as the upstream side in the axial direction, and the direction in which the working fluid 7 flows out is defined as the downstream side in the axial direction.

Figure 3:
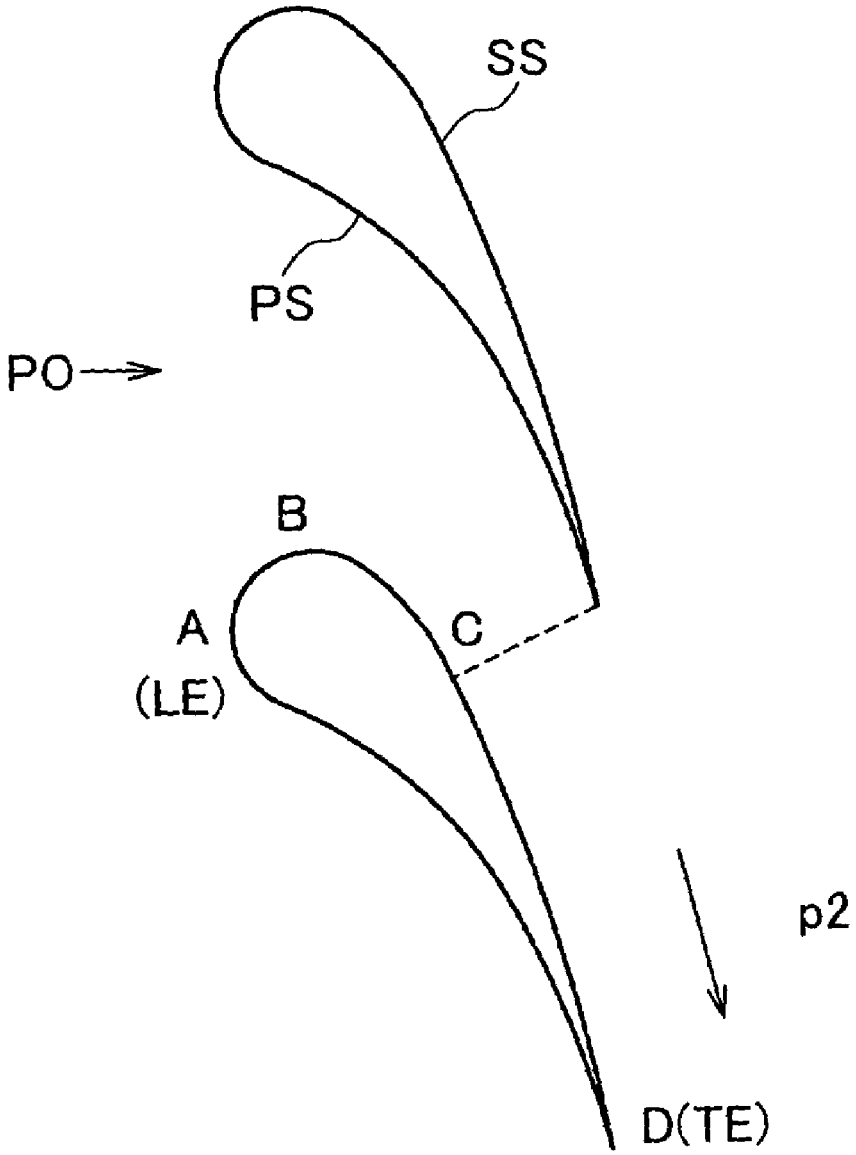
FIG. 3 shows a construction of a blade row according to the embodiment.

FIG. 3 shows a construction of row of turbine blades (stator blades) according to this embodiment. A static pressure P2 downstream of the blade is smaller than a total pressure P0 upstream of the blade. Therefore, a flow of the working fluid comes into the turbine in the axial direction and is bent in the circumferential direction along an inter-blade flow passage formed between two blades, whereby the flow is accelerated. Thus, the blade serves to convert a high-pressure, low-speed fluid at a blade inlet into a low-pressure, high-speed fluid. In other words, the blade serves to convert thermal energy of a high-pressure fluid into kinetic energy. In practice, however, the efficiency of such energy conversion is not 100%, and a part of the thermal energy is dissipated as a loss not available as work. To compensate for the loss, the high-pressure fluid must be introduced to flow into the turbine at a larger flow rate. Extra energy to be added correspondingly is increased as the loss increases. Stated another way, energy required for taking out the same amount of power is decreased as the loss decreases.

Regarding a blade operating in a subsonic region, losses attributable to a profile of the blade are mainly divided into a frictional loss due to friction that is generated between the fluid and a blade surface, and a trailing edge loss caused at a blade trailing edge having a finite thickness. The frictional loss is determined depending on a blade surface area and a pressure distribution along the blade surface. Namely, the frictional loss is increased as the blade surface area increases, and it is also increased as an inverse pressure gradient along the blade surface increases. Also, the trailing edge loss is substantially determined depending on a trailing edge thickness and a trailing-edge wedge angle of the blade. Because the trailing edge thickness and the trailing-edge wedge angle are each set to a minimum value allowable from the viewpoint of blade strength, the frictional loss is decreased as the number of blades decreases. Further, because energy that must be converted by an overall blade periphery, i.e., a blade load, is determined in the stage of design, a reduction in the number of blades corresponds to an increase in the blade load per blade. Even in the case of increasing the blade load per blade, if the size of one blade is increased, the surface area of the blade is also increased. Thus, an increase in the blade load per unit area of the blade results in a loss reduction. From the above description, it is understood that the energy conversion efficiency of the blade can be effectively increased by (1) increasing the blade load per unit area of the blade, and (2) reducing the inverse pressure gradient along the blade surface.

Figure 4:
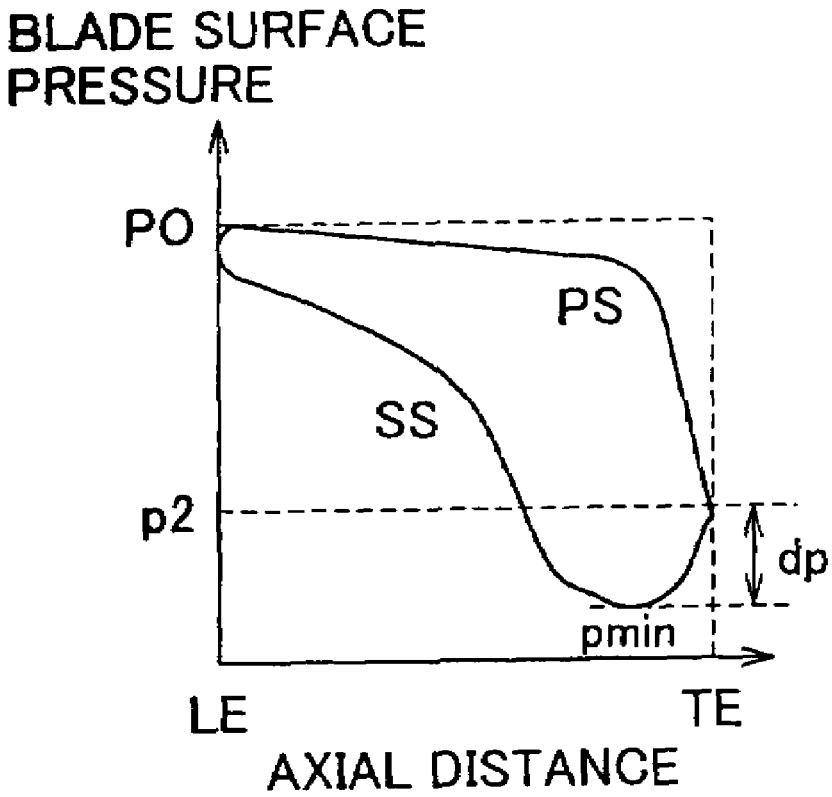
FIG. 4 plots a distribution of the blade surface pressure in a known blade.

FIG. 4 plots one example of a distribution of the blade surface pressure in a prior-art blade. P0 indicates a total pressure at an inlet, p2 indicates a static pressure at an outlet of the blade row, and pmin indicates a minimum pressure value along the blade surface. A curve representing a higher pressure denoted by PS is called a pressure surface, and a blade surface providing a lower pressure denoted by SS is called a suction surface. LE indicates a blade leading edge, and TE indicates a blade trailing edge. The blade load is equal to an area surrounded by PS and SS between LE and TE. Further, an amount indicated by dp represents a pressure difference between p2 and pmin. With an increase of dp, there occurs a pressure rise from pmin to p2 along the blade surface, i.e., an inverse pressure gradient. The inverse pressure gradient increases the thickness of a boundary layer or induces peeling-off of the boundary layer, thus resulting in a larger loss. If the number of conventional blades is decreased to reduce both the frictional losses and the trailing edge losses of the blades, an increase in the blade load per blade is concentrated in the downstream side of the blade and the inverse pressure gradient is increased. Hence, a larger loss is resulted contrary to the intention. For those reasons, dp must be kept small.

As is apparent from the above description, in order to increase the blade load per unit area of the blade in the blade having the blade load distribution shown in FIG. 4, it is effective to increase the blade load in the upstream side of the blade where the blade load is small in the prior art.

Figure 5:
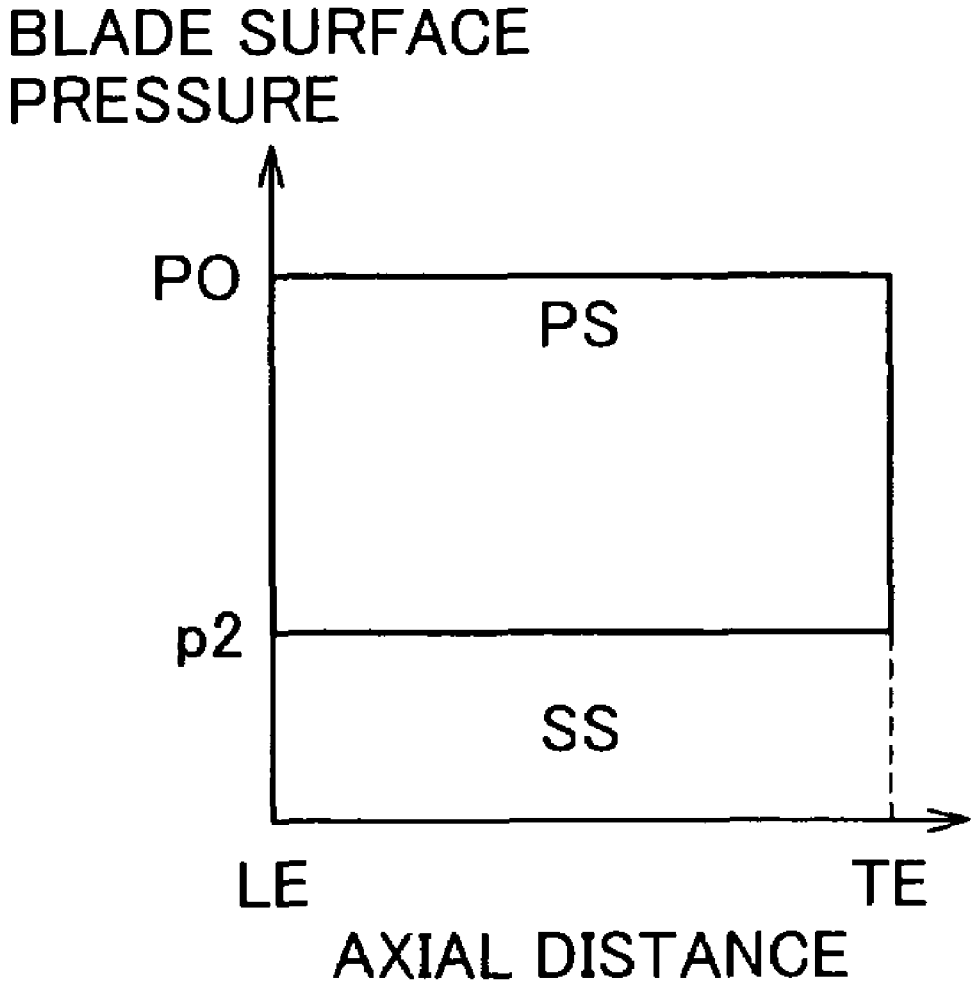
FIG. 5 plots an ideal distribution of the blade surface pressure.

FIG. 5 plots a pressure distribution of an ideal blade, in which dp is made 0 and the blade load is increased. The blade surface pressure is equal to the total pressure at the inlet over the entire pressure surface and is equal to the static pressure at the outlet over the entire suction surface. This is an ideal distribution of the blade surface pressure. However, such an ideal distribution cannot be realized in practice because there occurs a discontinuity in pressure at the leading edge and the trailing edge.

Figure 6:
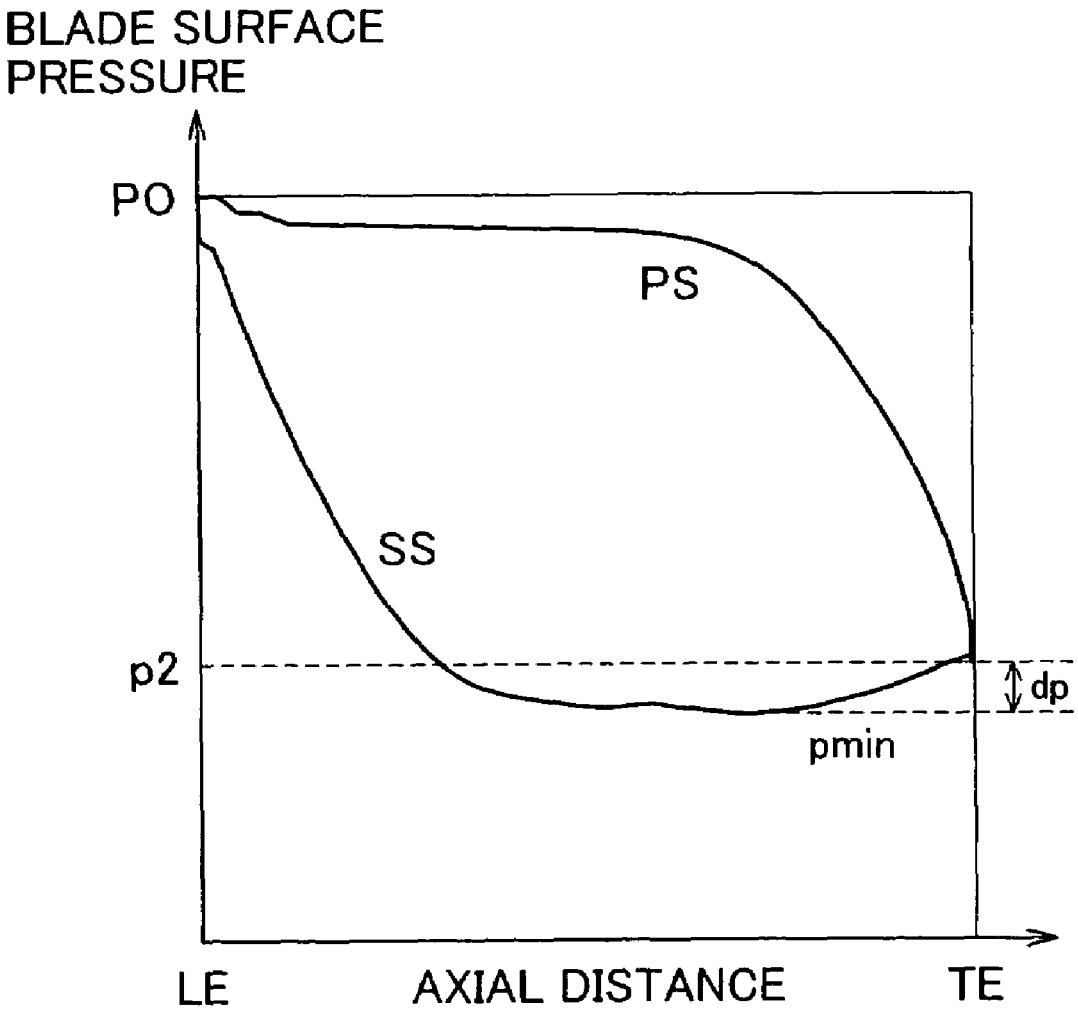
FIG. 6 plots a distribution of the blade surface pressure in the embodiment.

FIG. 6 plots a distribution of the blade surface pressure in the blade according to the embodiment shown in FIG. 3. As seen, the distribution of the blade surface pressure in the embodiment shown in FIG. 3 is closer to the ideal pressure distribution shown in FIG. 5. Comparing with the pressure distribution in the prior art shown in FIG. 4, it is understood that, in this embodiment, since the pressure on the suction surface (SS) side is reduced in the upstream side of the blade to increase the blade load, the blade load distribution per unit area can be increased without increasing the pressure difference dp between the static pressure P2 at the outlet of the blade row and the minimum pressure value pmin along the blade surface. The distribution of the blade surface pressure can be controlled depending on the curvature of the blade surface. This is because, assuming the curvature of the wall surface to be defined by the reciprocal 1/r of the radius r of the curvature, the relationship between the curvature 1/r of the wall surface and a local pressure gradient can be expressed as given below using a density ρ and a speed V:

$$\rho V^2/r=\partial p/\partial r$$

More specifically, the pressure at the wall surface is proportional to the product of the square of the speed near the wall surface and the curvature 1/r. The inter-blade flow in the turbine is an accelerated flow having a low flow speed at the inlet and a high flow speed at the outlet. Therefore, it is required to increase the curvature in order to lower the pressure at the inlet where the flow speed is low, and to decrease the curvature in order to make constant the pressure at the outlet where the flow speed is high. Thus, the pressure distribution along the blade suction surface, shown in FIG. 6, can be realized by monotonously decreasing the curvature of the blade suction surface in match with a monotonous increase of the flow speed.

Figure 1:
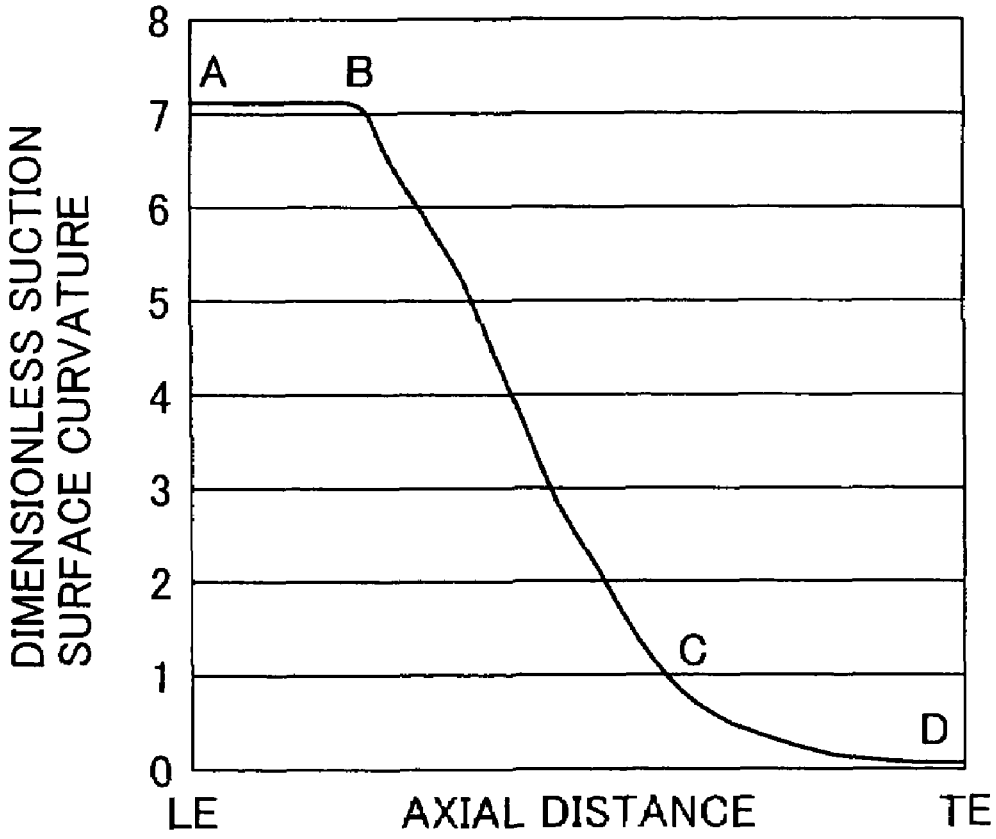
FIG. 1 plots a distribution of the dimensionless suction surface curvature of a blade according to one embodiment of the present invention.

FIG. 1 plots a distribution of the suction surface curvature of the turbine blade according to this embodiment. The horizontal axis represents the direction of a rotation axis, and the vertical axis represents the dimensionless suction surface curvature resulting from multiplying the curvature of the blade surface by a pitch t, i.e., the distance between two blades. As shown in FIG. 1, in the turbine blade according to this embodiment, the curvature of the blade surface decreases monotonously and continuously from the leading edge toward the trailing edge of the blade. Stated another way, according to this embodiment, in each of a plurality of blades arranged in the circumferential direction of a turbine driven for taking out power, as rotating forces, by utilizing a working fluid, the turbine blade is formed such that the curvature of a blade suction surface, which is defined by the reciprocal of the radius of curvature of a blade surface on the blade suction surface side, is decreased continuously and monotonously from a blade leading edge defined as the upstream-most point of the blade in the axial direction toward a blade trailing edge defined as the downstream-most point of the blade in the axial direction. Incidentally, when a portion of the blade near the blade trailing edge is in the form of a single arc, the blade trailing edge is defined as the downstream-most point of the blade except for that arc-shaped portion.

Thus, according to this embodiment, geometrical conditions of the blade profile for realizing an improvement of the efficiency is derived on the basis of fluid physics. As a result, the turbine blade of this embodiment is able to improve the efficiency of conversion from thermal energy of the fluid into kinetic energy or the efficiency of conversion from the kinetic energy into rotation energy of the rotor.

As seen from FIG. 6 plotting a distribution of the blade surface pressure resulting when the blade suction surface is formed so as to have the curvature distribution shown in FIG. 1, this embodiment can provide not only a relatively small inverse pressure gradient, but also the pressure distribution closer to the ideal pressure distribution shown in FIG. 5. Further, as a result of actually conducting a wind-tunnel test on the blade row, a reduction of loss was confirmed in comparison with the blade having the distribution of the blade surface pressure shown in FIG. 4.

The distribution of the blade suction surface curvature, plotted in FIG. 1, for realizing the pressure distribution plotted in FIG. 6, will be described in more detail below with reference to the blade profile shown in FIG. 3 for comparison.

First, in a region from a blade leading edge position A shown in FIG. 3 to a point B most projecting to the blade suction surface side, the dimensionless blade suction surface curvature, which is defined as a value resulting from multiplying the curvature of the blade surface by the pitch, i.e., the distance between two adjacent blades in the circumferential direction, is set to a certain value between 6 and 9 so that the pressure decreases in an area where the flow speed is low, taking into account the fact that the profile loss is not increased with thickening or peeling-off of the boundary layer along the blade surface even when the inflow angle with respect to the blade greatly differs from the design inflow angle of 90 degrees. In the embodiment shown in FIG. 1, the dimensionless blade suction surface curvature in the region from A to B is set to about 7.

If the dimensionless blade suction surface curvature in the region from A to B is smaller than 6, the effect obtainable with the present invention is reduced because the blade surface pressure near the blade leading edge is not decreased and the blade load per unit area cannot be increased. Also, a small value of the dimensionless blade suction surface curvature at the leading edge means that the radius of the blade leading edge is large and hence the size of the blade itself is increased, thus resulting in a larger blade surface area. On the other hand, if the dimensionless blade suction surface curvature is larger than 9, the blade surface pressure near the blade leading edge partly becomes lower than the pressure P2 at the outlet of the blade row. Consequently, there occurs an inverse pressure gradient in some area and the effect obtainable with the present invention is reduced.

Then, at a throat C defined as the point where the distance to the pressure surface of another adjacent blade is minimized, the dimensionless blade suction surface curvature is set to a value between 0.5 and 1.5. In the embodiment shown in FIG. 1, the dimensionless blade suction surface curvature at the throat C is set to about 0.8. If the dimensionless blade suction surface curvature is set larger than 1.5, the blade surface pressure is decreased because the flow speed is high at the throat C.

Consequently, the inverse pressure gradient dp is increased in an area from the throat toward the trailing edge and the effect obtainable with the present invention is reduced. Also, the curvature of the blade suction surface at the throat is related to a throttle rate of the inter-blade flow passage at the throat. If the dimensionless blade suction surface curvature at the throat is smaller than 0.5, the throttle rate of the inter-blade flow passage at the throat is reduced, whereby the flow speed upstream of the throat is increased and hence the position at which the blade surface pressure is minimized along the blade suction surface is located upstream of the throat. Consequently, the inverse pressure gradient occurs in a longer range from the throat toward the trailing edge and the effect obtainable with the present invention is reduced.

Further, in a region from the point B most projecting to the blade suction surface side to the throat C, the dimensionless blade suction surface curvature requires to be set so as to decrease monotonously and continuously. In this region, if the dimensionless blade suction surface curvature has an inflection point, undulation generates in the distribution of the blade surface pressure and the boundary layer along the blade surface is thickened in some cases. For this reason, the dimensionless blade suction surface curvature in the region from the point B most projecting to the blade suction surface side to the throat C is preferably provided as a straight line or a curve expressed by a function of the second degree, which has no inflection point, or a curve expressed by a function of the third degree, which has only one inflection point. In addition, because the boundary layer along the blade suction surface downstream of the throat is thickened in an increasing amount and tends to more easily peel off toward the trailing edge, the dimensionless blade suction surface curvature downstream of the throat is more preferably decreased monotonously such that a reduction rate of the curvature decreases toward the trailing edge.

Figure 7:
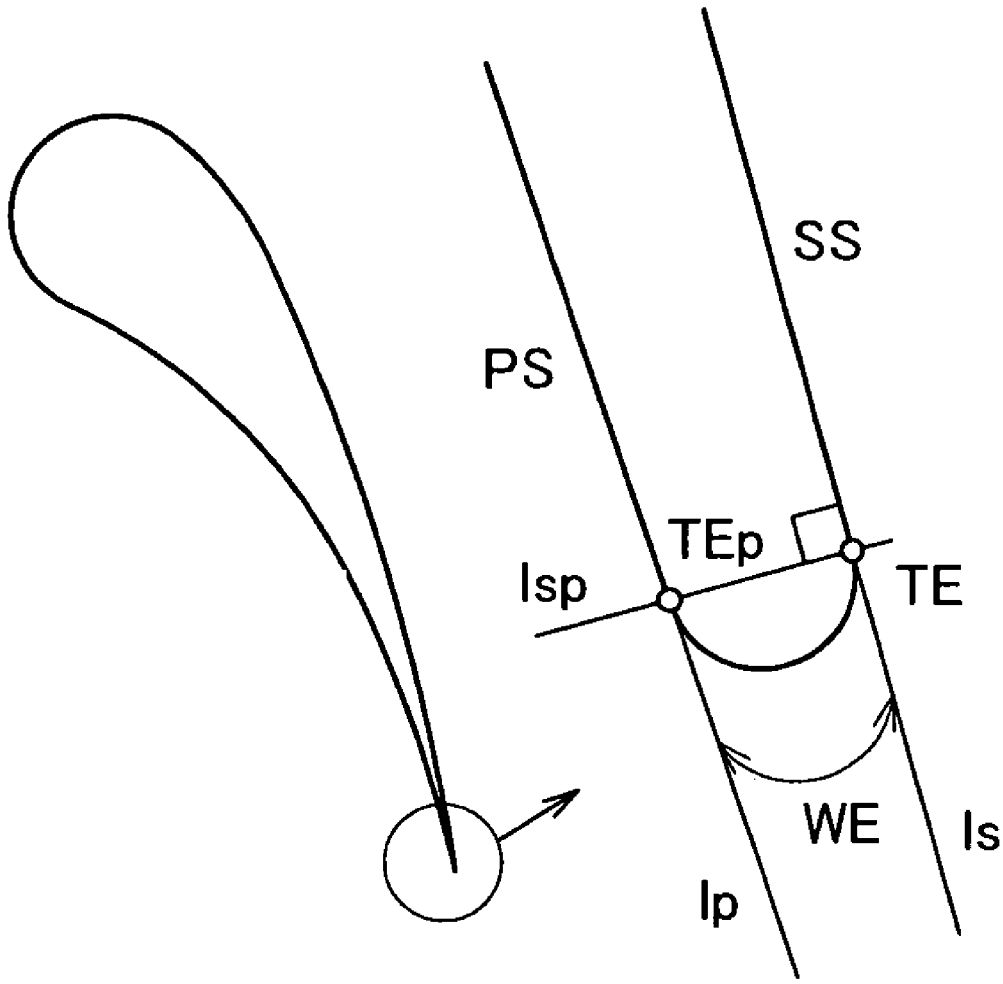
FIG. 7 shows a wedge angle at a blade trailing edge.

The wedge angle at the trailing edge of the turbine blade according to this embodiment will be described below with reference to FIG. 7. On an assumption that a point TEp at which a vertical line lsp drawn from a blade trailing edge TE toward a tangential line ls with respect to a blade suction surface SS at the blade trailing edge TE crosses a blade pressure surface PS is defined as a trailing edge of the blade pressure surface, a trailing-edge wedge angle WE is defined as an angle at which the tangential line ls with respect to the blade suction surface at the blade trailing edge TE and a tangential line lp with respect to the blade pressure surface at the blade pressure-surface trailing edge cross each other.

Figure 8:
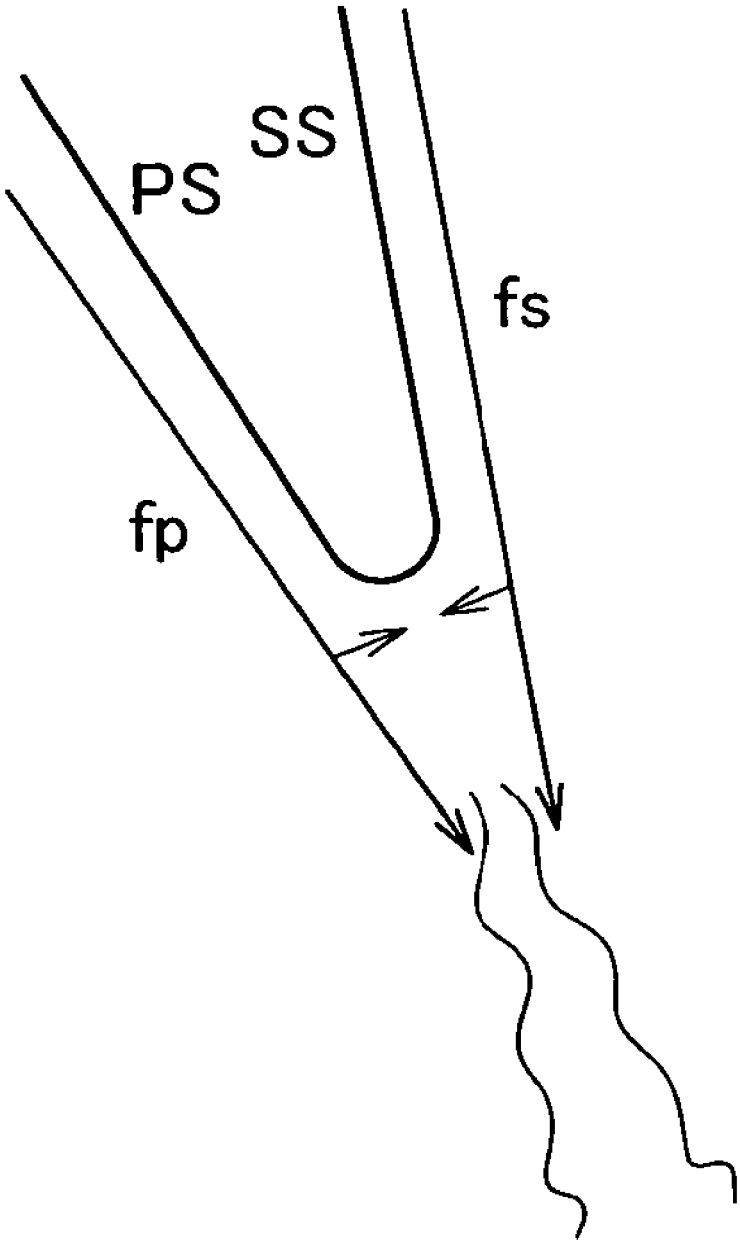
FIG. 8 illustrates a loss generating mechanism in an area near the blade trailing edge.

FIG. 8 schematically illustrates a loss generating mechanism in an area near the blade trailing edge. When a flow fs along the blade suction surface and a flow fp along the blade pressure surface collide against each other in an area downstream of the blade trailing edge, kinetic energy of the fluid dissipates as thermal energy, thus causing a profile loss. The kinetic energy lost upon the collision of those two flows is greatly affected by the magnitudes of speed components opposed to each other, and these speed components are in proportion to the trailing-edge wedge angle. From the viewpoint of reducing the profile loss, therefore, the trailing-edge wedge angle is preferably as small as possible. Thus, the trailing-edge wedge angle is required to be not larger than 6 degrees for realizing the pressure distribution according to this embodiment, plotted in FIG. 6, and suppressing the generation of loss at the trailing edge.

With the turbine blade of this embodiment, as described above, since the curvature of the blade suction surface is decreased monotonously from the leading edge to the blade trailing edge, the pressure along the blade suction surface can be reduced near the leading edge and can be made constant near the throat at a value substantially equal to the outlet static pressure. Therefore, the inverse pressure gradient can be suppressed small and the blade load per blade can be increased. It is hence possible to reduce the number of blades and to minimize both the blade surface area related to the frictional loss and the area of the blade trailing edge related to the trailing edge loss. As a result, the profile loss given as the sum of the frictional loss and the trailing edge loss can be reduced, and the turbine efficiency can be improved.

While the turbine blade of the present invention is suitably applied to a stator blade of a steam turbine, the present invention is not limited to such an application.

INDUSTRIAL APPLICABILITY

The turbine blade of the present invention is employed in the power generation field for production of electric power.

What is claimed is:

1. A turbine blade which is arranged in plural in the circumferential direction of a turbine driven by a working fluid, wherein said turbine blade is formed such that the dimensionless blade suction surface curvature, which is defined as a value resulting from multiplying the reciprocal of the radius of curvature of a blade surface on the blade suction surface side by a pitch defined by the distance between two adjacent blades in the circumferential direction, is set to a constant value in a region from a blade leading edge defined as the upstream-most point of the blade in the axial direction toward a point most projecting on the blade suction surface side and is decreased monotonously from said point most projecting on the blade suction surface side toward a blade trailing edge defined as the downstream-most point of the blade in the axial direction.

2. A turbine blade according to claim 1, wherein, assuming that a point at which a vertical line drawn from the blade trailing edge toward a tangential line with respect to the blade suction surface at the blade trailing edge crosses a blade pressure surface is defined as a trailing edge of the blade pressure surface, an angle at which the tangential line with respect to the blade suction surface at the blade trailing edge and a tangential line with respect to the blade pressure surface at the blade pressure-surface trailing edge cross each other is set to be not larger than 6 degrees.

3. A turbine blade according to claim 1, wherein the dimensionless blade suction surface curvature, which is defined as a value resulting from multiplying the curvature of the blade suction surface at the trailing leading edge by a pitch defined by the distance between two adjacent blades in the circumferential direction, is set to a certain value between 6 and 9.

4. A turbine blade according to claim 1, wherein the dimensionless blade suction surface curvature, which is defined as a value resulting from multiplying the curvature of the blade suction surface at a throat position, defined as a position where an inter-blade flow passage is narrowest, by a pitch, is set to a value between 0.5 and 1.5.

5. A turbine blade which is arranged in plural in the circumferential direction of a turbine driven by a working fluid, wherein said turbine blade is formed such that the dimensionless blade suction surface curvature, which is defined as a value resulting from multiplying the reciprocal of the radius of curvature of a blade surface on the blade suction surface side by a pitch defined by the distance between two adjacent blades in the circumferential direction is set to a constant value in a region from a blade leading edge defined as the upstream-most point of the blade in the axial direction toward a point most projecting on the blade suction surface side, is provided by a straight line or a curve expressed by a function of the second degree, which has no inflection point, in a region from said point most projecting on the blade suction surface side toward a point where the distance to a pressure surface of another adjacent blade is minimized, and is decreased continuously and monotonously in a region from said point where the distance to the pressure surface of another adjacent blade is minimized toward a blade trailing edge defined as the downstream-most point of the blade in the axial direction such that a reduction rate decreases toward the trailing edge.

6. A turbine blade which is arranged in plural in the circumferential direction of a turbine driven by a working fluid wherein the dimensionless blade suction surface curvature, which is defined as a value resulting from multiplying the curvature of a blade suction surface defined by the reciprocal of the radius of curvature of a blade surface on the blade suction surface side by a pitch defined by the distance between two adjacent blades in the circumferential direction, is set to a certain value between 6 and 9 in a region from a blade leading edge defined as the upstream-most point of the blade in the axial direction to a point most projecting on-the blade suction surface side, and is set to a value between 0.5 and 1.5 at a throat position defined as a point where the distance to a pressure surface of another adjacent blade is minimized, and the dimensionless blade suction surface curvature is decreased linearly monotonously in a region from said point most projecting on the blade suction surface side to said throat point, and is decreased monotonously in a region from said throat point to the blade trailing edge such that a reduction rate of the dimensionless blade suction surface curvature decreases toward the trailing edge.

7. A turbine blade which is arranged in plural in the circumferential direction of a turbine driven by a working fluid, wherein the dimensionless blade suction surface curvature, which is defined as a value resulting from multiplying the curvature of a blade suction surface defined by the reciprocal of the radius of curvature of a blade surface on the blade suction surface side by a pitch defined by the distance between two adjacent blades in the circumferential direction, is set to a certain value between 6 and 9 in a region from a blade leading edge defined as the upstream-most point of the blade in the axial direction to a point most projecting on-the blade suction surface side, and is set to a value between 0.5 and 1.5 at a throat position defined as a point where the distance to a pressure surface of another adjacent blade is minimized, and the dimensionless blade suction surface curvature in a region from said point most projecting to the blade suction surface side to said throat point is provided by a straight line or a curve expressed by a function of the second degree, which has no inflection point, or a curve expressed by a function of the third degree, which has only one inflection point, and is decreased monotonously in a region from said throat point to the blade trailing edge such that a reduction rate of the dimensionless blade suction surface curvature decreases toward the trailing edge.

8. A turbine comprising a plurality of stator blades and moving blades arranged in the circumferential direction of a rotor, a row of said stator blades and a row of said moving blades constituting a turbine stage, wherein said stator blades are each formed such that the dimensionless blade suction surface curvature, which is defined as a value resulting from multiplying the reciprocal of the radius of curvature of a blade surface on the blade suction surface side by a pitch defined by the distance between two adjacent blades in the circumferential direction is set to a constant value from a blade leading edge defined as the upstream-most point of the blade in the axial direction toward a point most projecting on the blade suction surface side, and is decreased monotonously from said point most projecting on the blade suction surface side toward a blade trailing edge defined as the downstream-most point of the blade in the axial direction.

9. A turbine blade comprising a plurality of stator blades and moving blades arranged in the circumferential direction of a rotor, two rows of said stator blades and said moving blades constituting a turbine stage, wherein said stator blades are each formed such that the dimensionless blade suction surface curvature, which is defined as a value resulting from multiplying the reciprocal of the radius of curvature of a blade surface on the blade suction surface side by a pitch defined by the distance between two adjacent blades in the circumferential direction is set to a constant value in a region from a blade leading edge defined as the upstream-most point of the blade in the axial direction toward a point most projecting on the blade suction surface side, is provided by a straight line or a curve expressed by a function of the second degree, which has no inflection point, in a region from said point most projecting on the blade suction surface side toward a point where the distance to a pressure surface of another adjacent blade is minimized, and is decreased monotonously in a region from said point where the distance to the pressure surface of another adjacent blade is minimized toward a blade trailing edge defined as the downstream-most point of the blade in the axial direction such that a reduction rate decreases toward the blade trailing edge.

* * * * *